US008484879B2

(12) United States Patent
Riley et al.

(10) Patent No.: US 8,484,879 B2
(45) Date of Patent: Jul. 16, 2013

(54) LIGHT MOUNT FOR SCOPE

(75) Inventors: Louis F. Riley, Weston, FL (US); Vincent D. Abrams, Boca Raton, FL (US)

(73) Assignee: Laser Genetics of America, Ft. Lauderdale, FL (US)

( * ) Notice: Subject to any disclaimer, the term of this patent is extended or adjusted under 35 U.S.C. 154(b) by 200 days.

(21) Appl. No.: 13/209,955

(22) Filed: Aug. 15, 2011

(65) Prior Publication Data

US 2012/0085014 A1 Apr. 12, 2012

Related U.S. Application Data

(60) Provisional application No. 61/373,614, filed on Aug. 13, 2010.

(51) Int. Cl.
*F41G 1/00* (2006.01)
*F41G 1/32* (2006.01)

(52) U.S. Cl.
USPC ..... 42/115; 362/110

(58) Field of Classification Search
USPC ..... 42/114, 115, 146
See application file for complete search history.

(56) References Cited

U.S. PATENT DOCUMENTS

| | | | | |
|---|---|---|---|---|
| 3,867,764 | A * | 2/1975 | Dunmire et al. | 42/115 |
| 3,974,585 | A * | 8/1976 | Dunham | 42/113 |
| 4,707,772 | A * | 11/1987 | Jimenez et al. | 362/110 |
| 5,671,561 | A * | 9/1997 | Johnson et al. | 42/114 |
| 5,913,669 | A * | 6/1999 | Hansen et al. | 42/146 |
| 5,997,163 | A | 12/1999 | Brown | |
| 6,616,301 | B2 | 9/2003 | Brown et al. | |
| 6,799,868 | B2 | 10/2004 | Brown et al. | |
| 7,134,234 | B1 * | 11/2006 | Makarounis | 42/146 |
| 7,731,380 | B2 * | 6/2010 | Wu | 362/113 |
| 7,882,654 | B1 * | 2/2011 | Marcum et al. | 42/90 |
| 2004/0035991 | A1 * | 2/2004 | Wooten et al. | 248/229.1 |
| 2006/0026888 | A1 * | 2/2006 | Cheng et al. | 42/146 |
| 2008/0134562 | A1 * | 6/2008 | Teetzel | 42/146 |
| 2012/0180370 | A1 * | 7/2012 | Mckinley | 42/146 |

* cited by examiner

*Primary Examiner* — Bret Hayes
(74) *Attorney, Agent, or Firm* — Hartman Global IP Law; Gary M. Hartman; Domenica N. S. Hartman

(57) ABSTRACT

Mount assemblies for securing laser sights (designators) to a wide variety of guns through mounting of the designator directly to an existing conventional scope. The mount assembly includes a base adapted for attaching the mount assembly to a scope, a rail pivotally attached to the base, and a ring assembly on the rail for mounting the designator to the rail. A first adjustment mechanism is provided for pivoting the rail in a first plane toward and away from the base to effect elevation changes in the trajectory of a laser beam generated by the designator, and a second adjustment mechanism is provided for pivoting the rail relative to the base in a second plane to effect windage changes in the trajectory of the laser beam.

20 Claims, 10 Drawing Sheets

LIGHT MOUNT FOR SCOPE

CROSS REFERENCE TO RELATED APPLICATIONS

This application claims the benefit of U.S. Provisional Application No. 61/373,614, filed Aug. 13, 2010, the contents of which are incorporated herein by reference.

BACKGROUND OF THE INVENTION

The present invention generally relates to devices adapted to mount a light to a scope of a firearm, air gun, airsoft gun, etc.

Telescopic sights, or scopes, are commonly mounted on firearms including handguns, long guns, and automatic weapons, air guns including air pistols and air rifles, airsoft guns, and various other types of equipment. Optical sights and especially laser sights are also becoming more common for military, hunting and recreational use. Lasers emit a beam of coherent light that is concentrated and unidirectional, and are therefore preferred for targeting use over other forms of light that are incoherent, relatively weak, and omni-directional.

In most cases, a laser sight (or "laser designator") is mounted to a scope to emit a laser beam parallel to the axes of the scope and barrel from which a projectile is fired. The laser light appears as a small spot over long distances, enabling the user to place the spot on a target viewed through the reticle of the scope and, in doing so, indicate the trajectory of the projectile (not taking into consideration elevation (drop) and windage). Whereas most laser sights use a red laser diode, infrared diodes and other laser light colors have been used, including green laser diodes. Green laser beams having a wavelength of 532 nm are advantageous because green light is at the peak of the human eye's sensitivity, thereby producing more visible light with less energy compared to other light sources. Such efficiencies reduce the power requirements of the laser, and therefore increase battery life. FIG. 14 schematically represents the operation of a green DPSS (diode-pumped solid-state) laser of a type known in the art. A commercial example of a laser designator using this technology is the ND-3 and ND-5 series available from Laser Genetics, Inc.

Laser sights are often rigidly mounted, resulting in the inability of the user to make elevation (vertical) and windage (horizontal) adjusts to the laser beam.

BRIEF DESCRIPTION OF THE INVENTION

The present invention provides mount assemblies for securing laser sights (designators) to a wide variety of firearms, air guns, airsoft guns, etc., through mounting of the designator directly to an existing conventional telescopic sight (scope).

According to a first aspect of the invention, a mount assembly includes a base comprising means for attaching the mount assembly to a scope, a rail pivotally attached to the base so as to pivot in first and second planes relative to the base, and a ring assembly on the rail for mounting a laser designator to the rail. In addition, a first adjustment means is provided for pivoting the rail in the first plane toward and away from the base to effect elevation changes in the trajectory of a laser beam generated by the designator mounted to the mount assembly, and a second adjustment means is provided for pivoting the rail relative to the base in the second plane to effect windage changes in the trajectory of a laser beam generated by the designator mounted to the mount assembly.

Another aspect of the invention is a method of effecting elevation and windage changes in the trajectory of a laser beam generated by a designator mounted to a scope using a mount assembly comprising the elements described above. The method includes using the first adjustment means to cause the rail to pivot in the first plane toward and away from the base and effect an elevation change in the trajectory of the laser beam, using the second adjustment means to cause the rail to pivot relative to the base in the second plane and effect a windage change in the trajectory of the laser beam, and then setting the elevation and windage changes.

A technical effect of the invention is that the mount assemblies enable a user to make very fine elevation and windage adjustments to the trajectory of a laser beam produced by a designator mounted to a scope, enabling the user to place the illumination of the laser beam on an object being viewed through the reticle of the scope.

Other aspects and advantages of this invention will be better appreciated from the following detailed description.

DETAILED DESCRIPTION OF THE INVENTION

Figure 8:
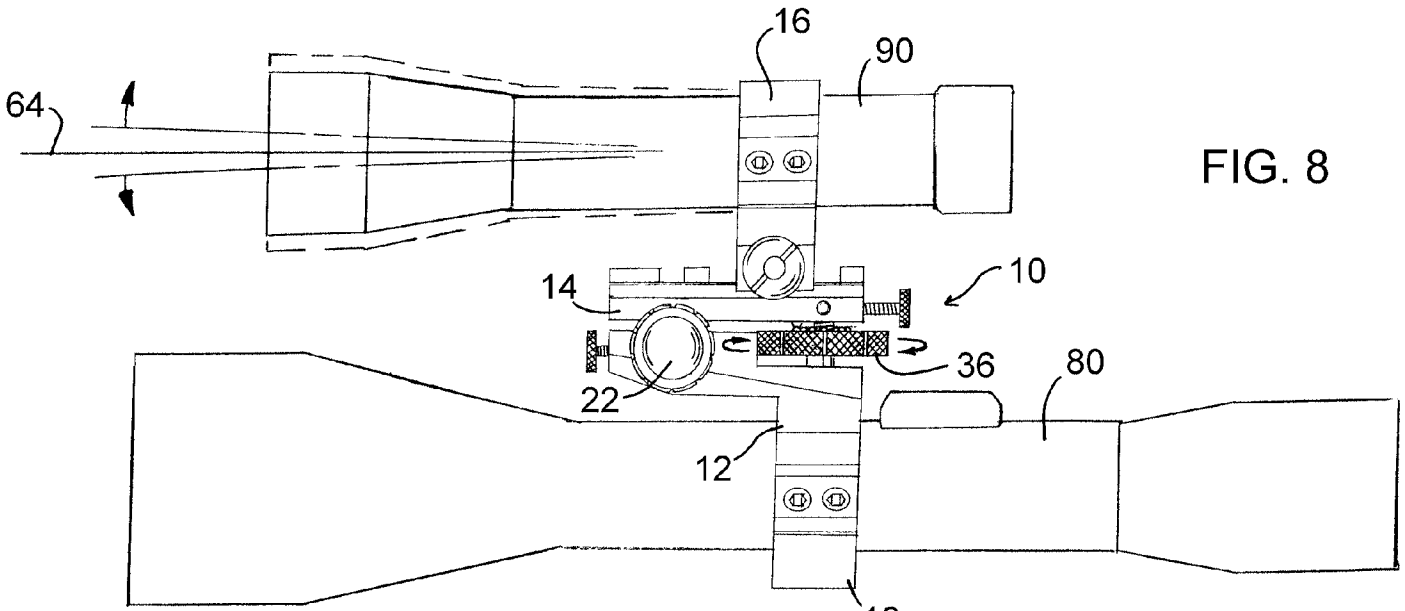
FIGS. 8 and 9 depict the capability of the mount of FIGS. 1 through 5 to make elevation and windage adjustments, respectively, the trajectory of a laser beam relative to a scope.
Figure 9:
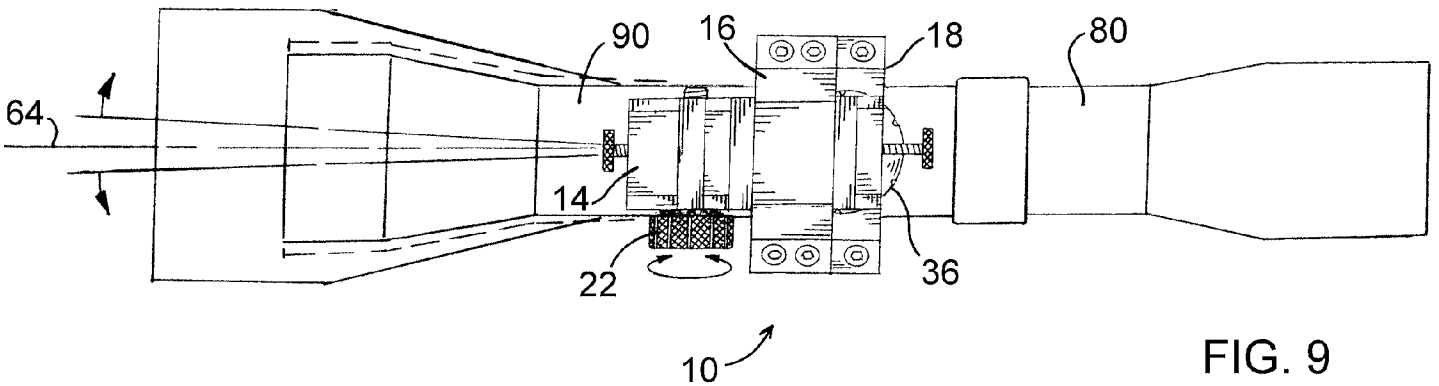
Figure 10:
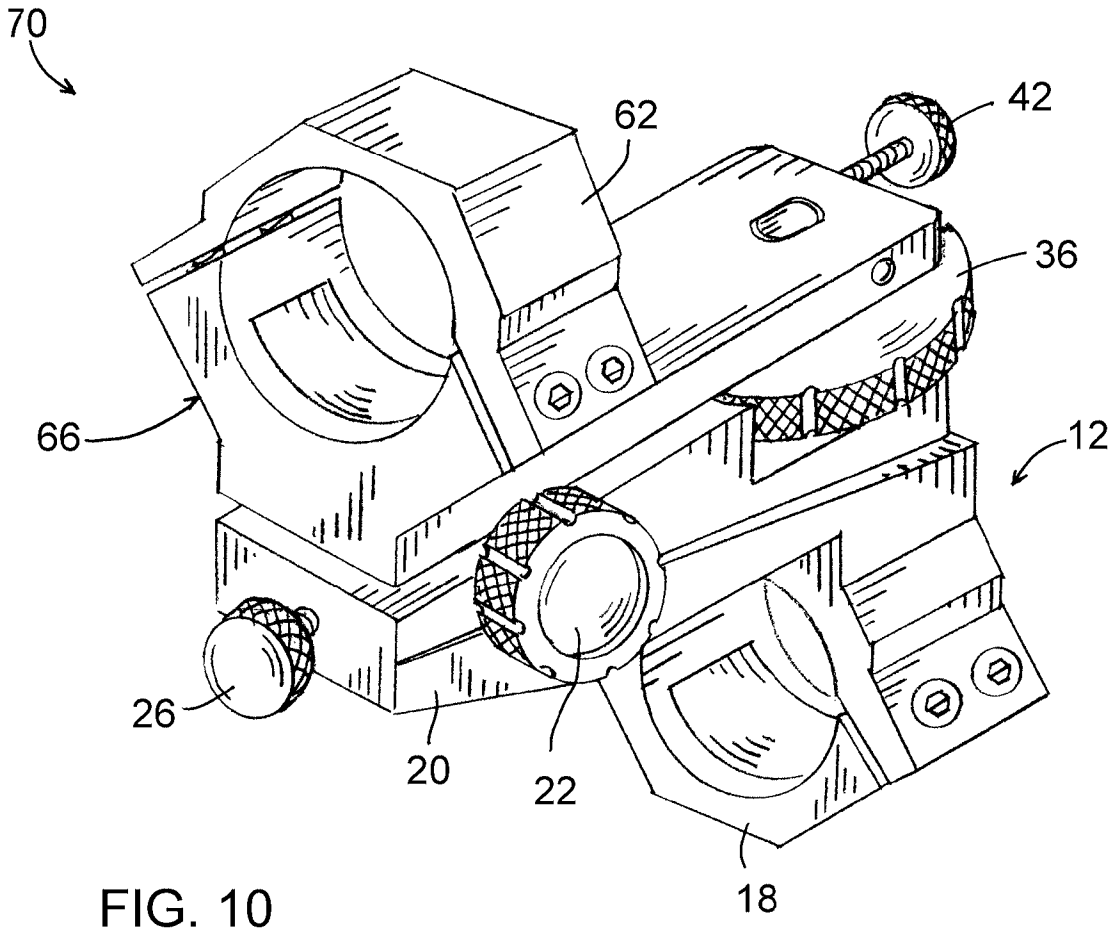
FIGS. 10 through 13 show various views of a mount assembly in accordance with a second embodiment of the invention.
Figure 11:
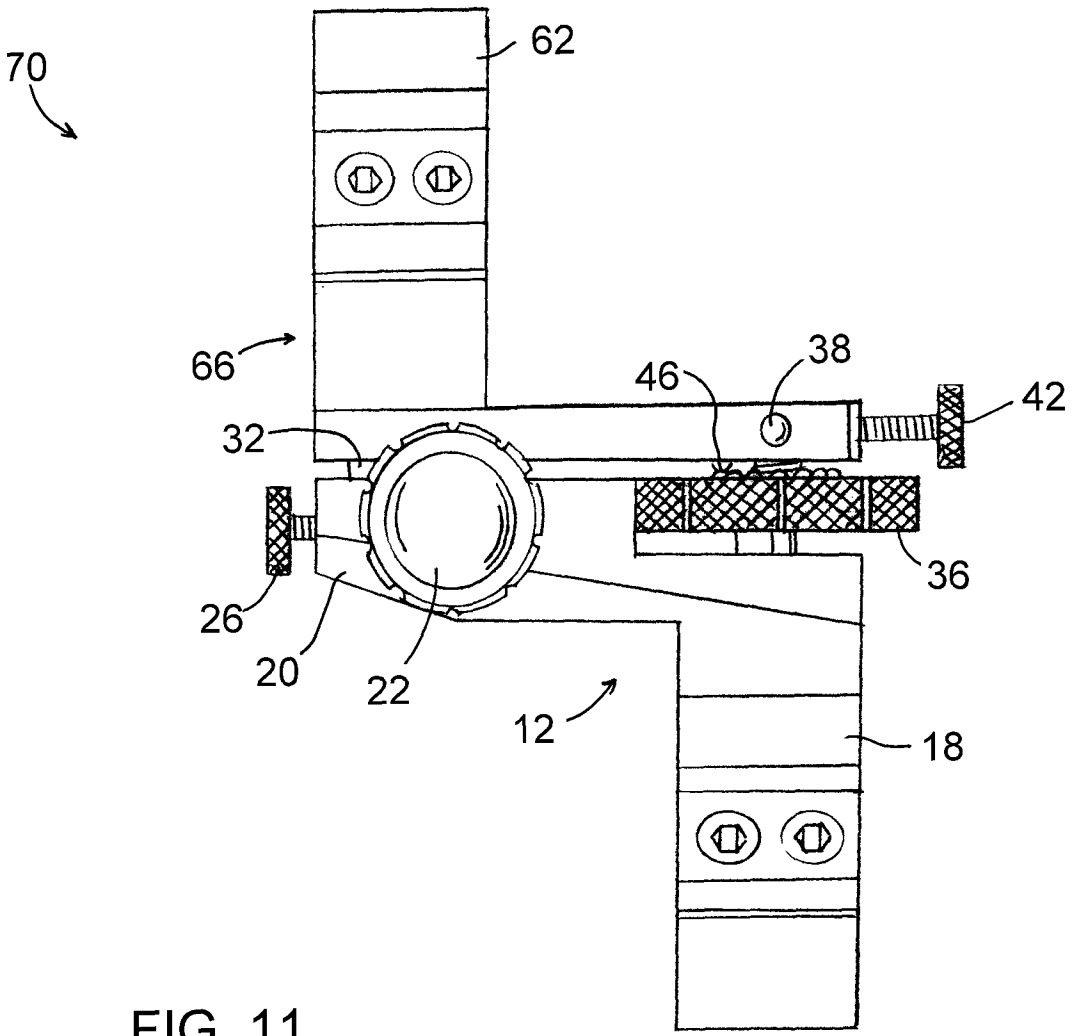
Figure 12:
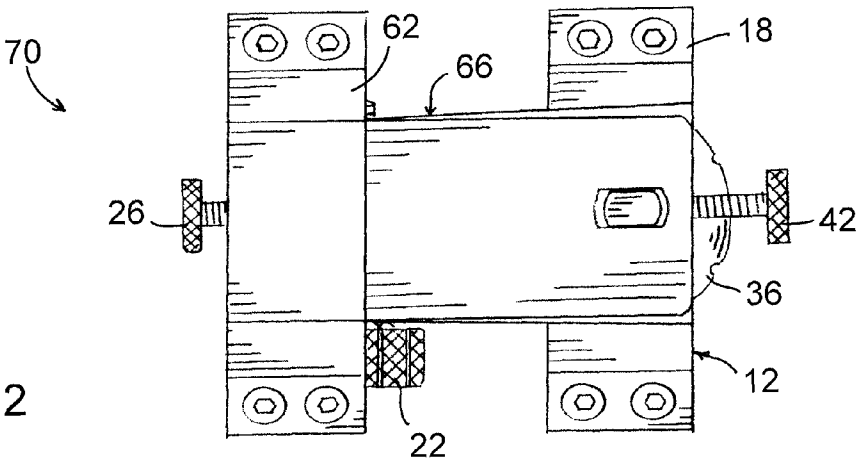
Figure 13:
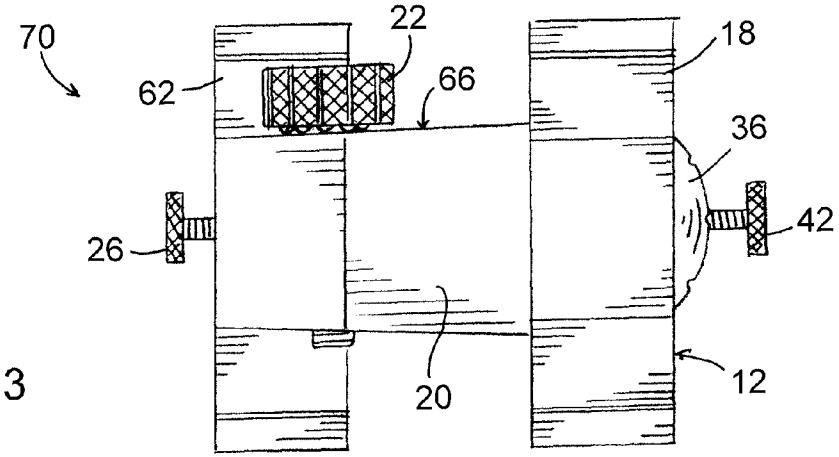
Figure 14:
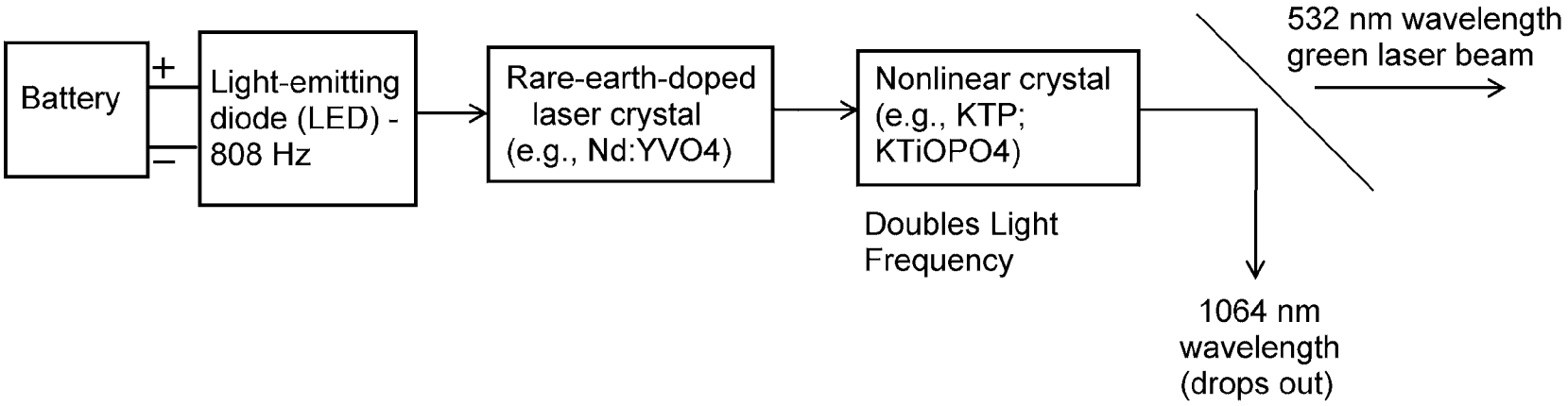
FIG. 14 schematically represents the operation of a green DPSS laser of a type known in the art, and which is suitable for generating a laser beam from a laser designator that can be mounted with the mount assemblies of this invention.

FIGS. 1 through 9 show a laser sight mount assembly 10 comprising a base 12 for attaching the mount assembly 10 to a scope 80 (FIGS. 8 and 9), a rail 14 pivotally attached to the base 12, and a ring assembly 16 adjustably mounted to the rail 14 for mounting a designator 90 (FIGS. 8 and 9). Examples of suitable designators include but are limited to the ND-3 and ND-5 series available from Laser Genetics, Inc.

To facilitate the description of the assembly 10 provided below, the terms "vertical," "horizontal," "front," "rear," "forward," "rearward," "side," "upper," "lower," "above," "below," "right," "left," etc., will be used in reference to the perspective of one using the assembly 10 when mounted on a scope, and therefore are relative terms and should not be otherwise interpreted as limitations to the construction and use of the assembly 10.

The base 12 comprises a two-piece mounting ring 18 adapted for gripping a scope 80 (as shown in FIGS. 8 and 9), and a platform 20 that is above and extends forward of the ring 18. A threaded shaft 23 of a windage adjustment screw 22 is received in a transverse bore 24 (FIG. 5) in the platform 20 and engages a nut 25 on the opposite side of the base 12. A set screw 26 is threaded into the front surface of the platform 20 and extends into a slot 28 (FIG. 5) in the upper surface of the base 12, where the set screw 26 is able to engage the shaft 23 of the adjustment screw 22 to prevent the adjustment wheel 22 from rotating. The platform 20 is also formed to have a bore 30 in its upper surface above the ring 18.

The rail 14 comprises a flange 32 received in the slot 28 of the base 12, and a threaded bore 34 is defined in the flange 32 through which the threaded shaft 23 of the adjustment screw 22 is threaded to secure the rail 14 to the base 12 while also defining a pivot axis about which the rail 14 is able to pivot relative to the base 12 in a vertical plane. A lower shaft 37 of an elevation adjustment wheel 36 is threaded into a nut 31 within the bore 30 in the base 12, and an upper shaft 39 of the adjustment wheel 36 is received in a bore (shown in FIG. 7) in the lower surface of the rail 14. A pin 38 engages a groove 40 on the upper shaft 39 of the wheel 36 to retain the adjustment wheel 36 to the rail 14. The shafts 37 and 39 of the adjustment wheel 36 define a second pivot axis about which the rail 14 pivots relative to the base 12 in a horizontal plane (i.e., transverse to the vertical pivot plane established by the shaft 23 of the adjustment screw 22). A set screw 42 threaded into the rail 14 is able to engage the upper shaft 39 of the wheel 36 and thereby prevent the adjustment wheel 36 from rotating.

From FIGS. 1 through 9, it can be seen that the pivot axes defined by the shafts 23, 37 and 39, and about which the rail 14 and ring assembly 16 pivot in unison relative to the base 12, are located at opposite ends of the mount assembly 10. Turning of the adjustment wheel 36 (located at the rearward end of the assembly 10) results in the threaded lower shaft 37 of the wheel 36 acting as a power screw with the nut 31 (FIG. 7), causing the rearward end of the rail 14 to be raised and lowered relative to the base 12 and the entire rail 14 to pivot in the vertical plane about the shaft 23 of the adjustment wheel 22. Turning the adjustment screw 22 (located at the forward end of the assembly 10) causes the flange 32 (which is narrower than the slot 28) to move transversely within the slot 28 (FIG. 6) and cause the entire rail 14 to pivot in the horizontal plane about the upper shaft 39 of the adjustment wheel 36. The set screw 26 engages the front face of the flange 32 to secure the rotational position of the rail 14 relative to the base 12. A spring 52 (FIGS. 5 and 7) is preferably provided to bias the rail 14 away from the base 12 so that, when the set screw 26 is not engaged, the rail 14 is able to freely rotate relative to the base 12, as well as eliminate free-play between the rail 14 and base 12.

Figure 5:
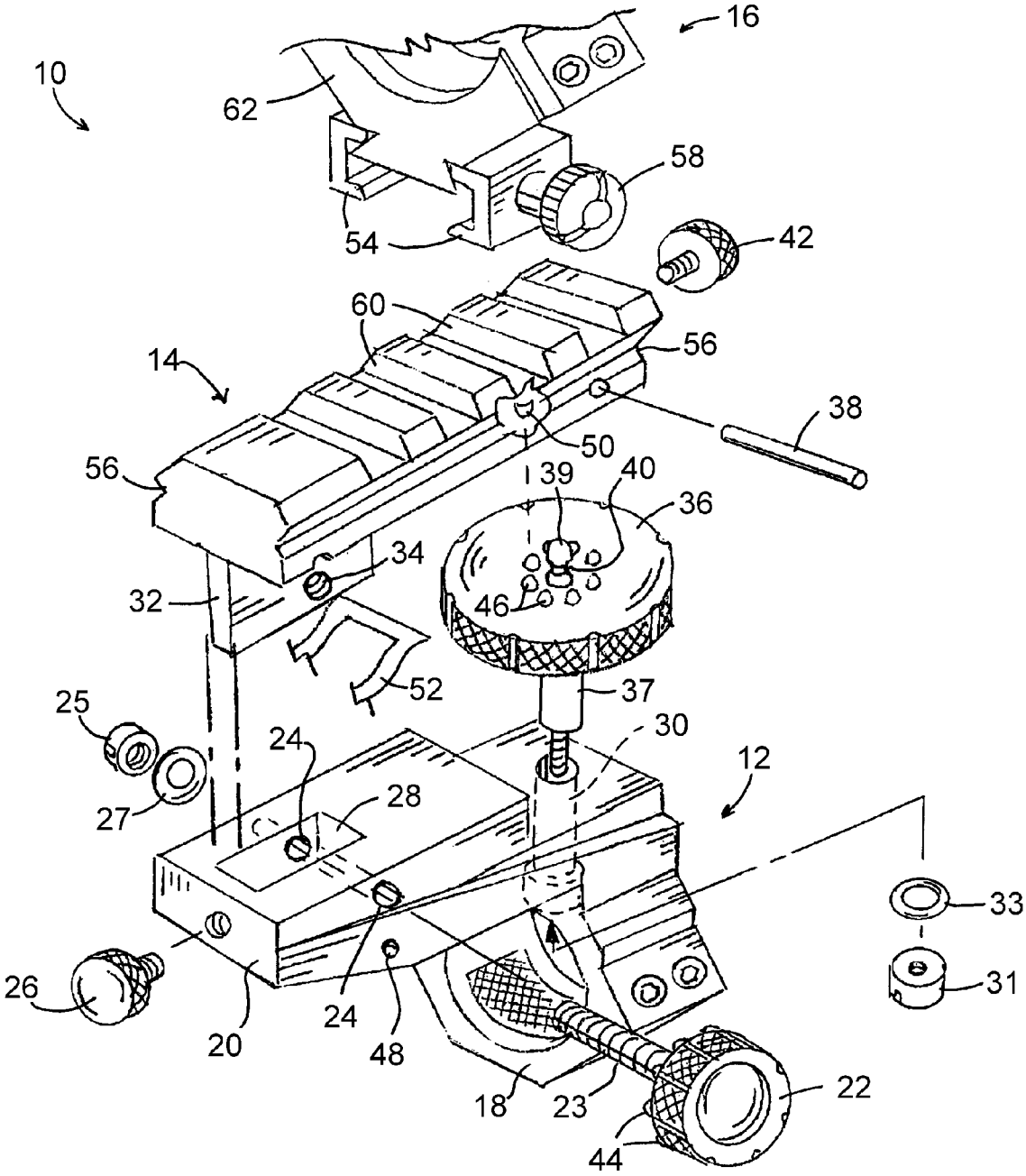
Figure 7:
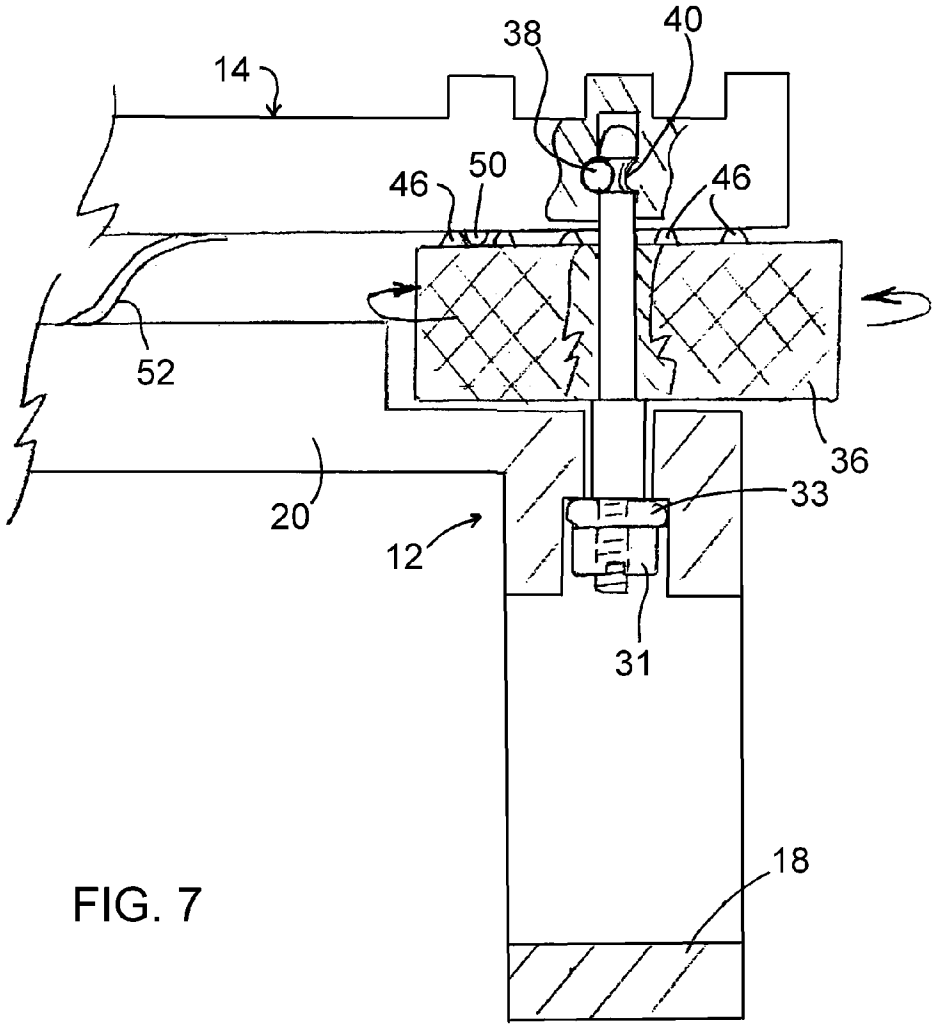
FIGS. 6 and 7 show fragmentary cross-sectional views of the mount assembly of FIGS. 1 through 5.
Figure 6:
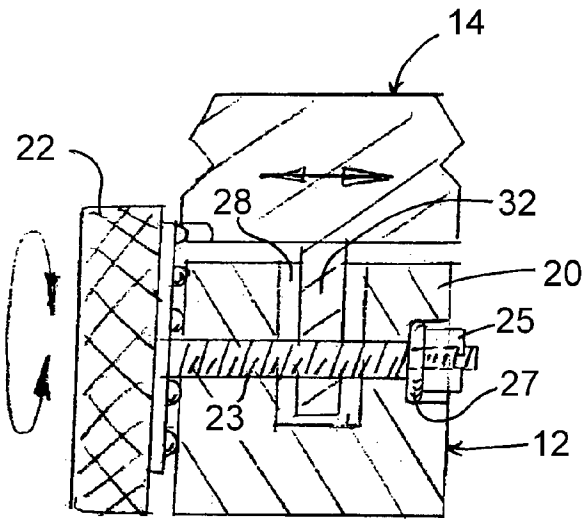

As evident from FIG. 5, the rotational position of the adjustment screw 22 can be assisted with complementary detent features 44 and 48 defined in the opposing faces of the screw 22 and platform 20, and the rotational position of the adjustment wheel 36 can be assisted with complementary detent features 46 and 50 defined in the opposing faces of the wheel 36 and rail 14. The nuts 25 and 31 are shown as being accompanied by elastic washers 27 and 33, respectively, which are compressible to provide for slight axial movement of the adjustment screw 22 and adjustment wheel 36 as their respective detent features 44, 46, 48 and 50 engage and disengage each other.

Figure 1:
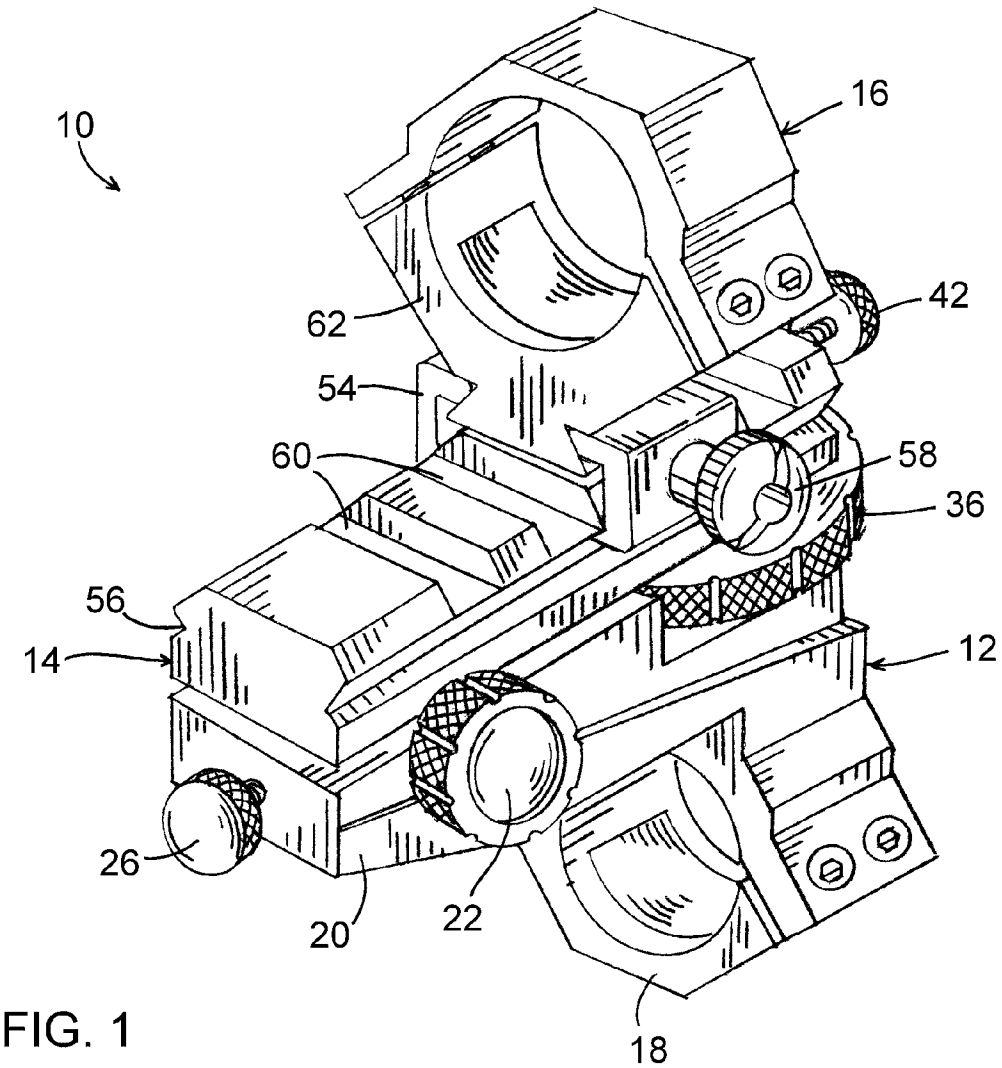
FIGS. 1 through 5 show various views of a mount assembly in accordance with a first embodiment of the invention.
Figure 2:
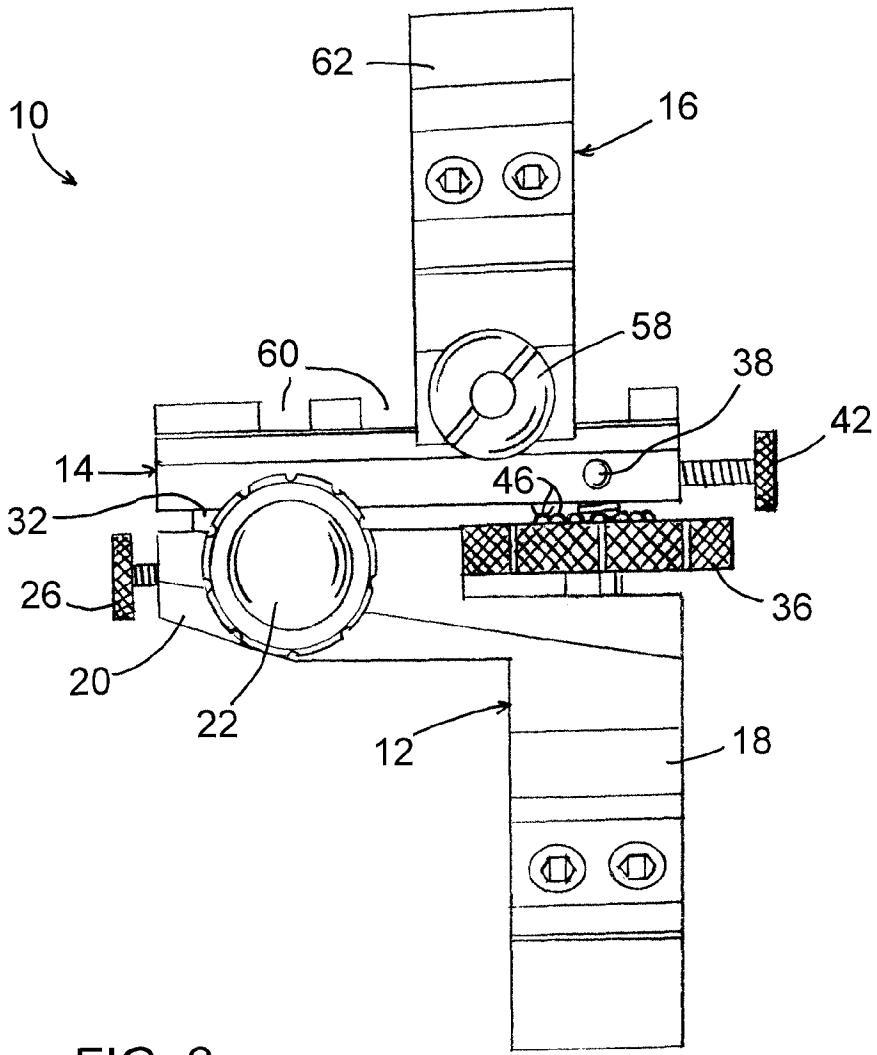
Figure 3:
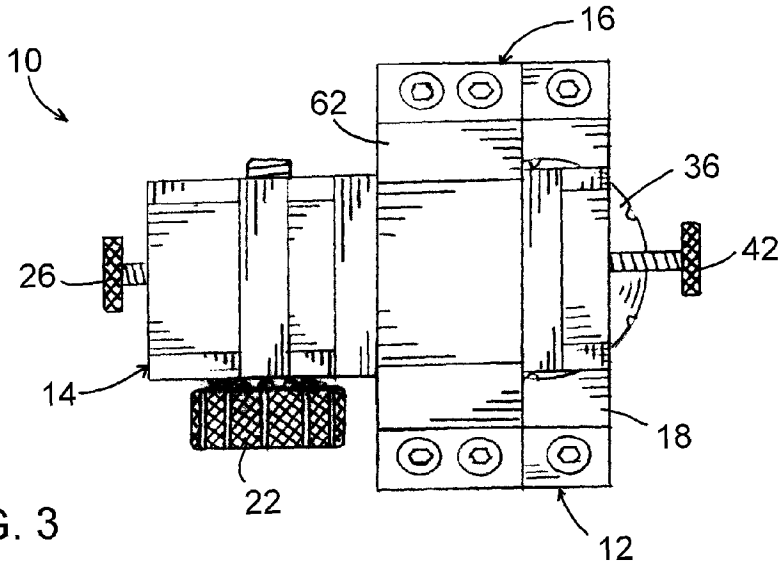
Figure 4:
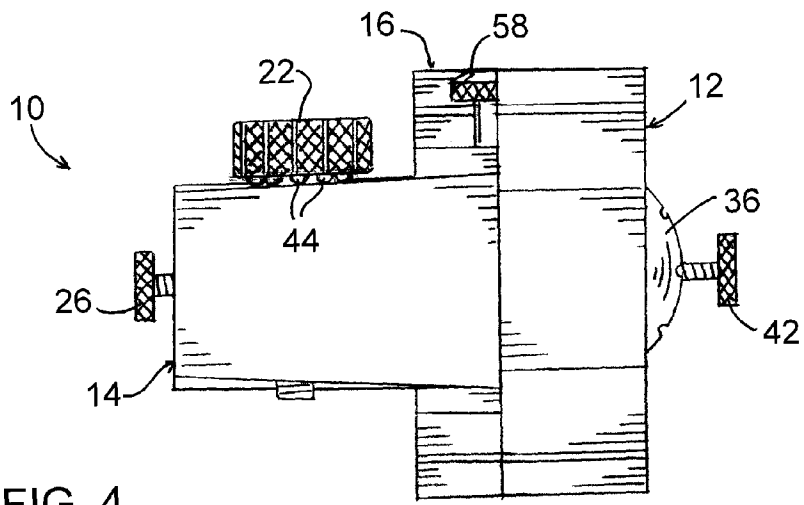

As shown in FIGS. 8 and 9, the ring assembly 16 serves to attach the designator 90 to the rail 14. As seen in FIGS. 1 and 5, a pair of U-shaped channels 54 are slidably engaged with a weaver rail 56 formed in the sides of the rail 14, and a set screw 58 serves to clamp the channels 54 to the rail 14. Slots 60 formed in the upper surface of the rail 14 provide for incremental positioning of the ring assembly 16 in the forward and rearward linear directions along the length of the rail 14. Finally, the ring assembly 16 includes a two-piece ring 62 configured to clamp around the designator 90.

FIGS. 8 and 9 illustrate the manner in which rotation of the adjustment wheel 36 and adjustment screw 22 effect elevation and windage changes, respectively, in the trajectory of a laser beam 64 generated by the designator 90 mounted by the assembly 10 to a scope 80.

A second laser sight mount assembly 70 is represented in FIGS. 10 through 13 that is similar to the assembly 10 of FIGS. 1 through 9, with the key difference being that the separate rail 14 and ring assembly 16 shown in FIGS. 1 through 9 have been replaced with a unitary piece 66. For convenience, identical reference numerals are used in FIGS. 10 through 13 to denote the same or functionally equivalent elements described for the assembly 10 of FIGS. 1 through 9. The portion of the unitary piece 66 corresponding to the rail 14 of FIGS. 1 through 9 is still referred to as a rail 14 even though, as explained below, the rail 14 shown in FIGS. 10 through 13 does not have all of the functions of the rail 14 shown in FIGS. 1 through 9.

By merging the separate rail 14 and ring assembly 16 of FIGS. 1 through 9 into the unitary piece 66 of FIGS. 10 through 13, the channels 54, weaver rail 56, set screw 58, and slots 60 are no longer required to adjust the ring assembly 16 in a forward and rearward direction relative to the rail 14. Though the ability to move the ring assembly 16 relative to the rail 14 has been eliminated, the configurations and operations of the adjustment screw 22 and adjustment wheel 36 are essentially the same as described above. Specifically, through the pivotal connections between the rail 14 and the base 12, the unitary piece 66 is able to pivot relative to the base 12 to make windage and elevation changes, respectively, to the trajectory of a laser beam generated by a designator (not shown) mounted by the assembly 70 to a scope, in the same manner as shown in FIGS. 8 and 9. As with the assembly 10 of FIGS. 1 through 9, turning of the adjustment wheel 36 results in the threaded lower shaft 37 (FIG. 11) of the wheel 36 acting as a power screw with the nut (not shown; corresponding to the nut 31 seen in FIG. 7), causing the rearward end of the rail 14 to be raised and lowered relative to the base 12 and the entire rail 14 to pivot in a vertical plane about the shaft 23 (FIG. 13) of the adjustment wheel 22, and turning the adjustment screw 22 causes the flange of the rail 14 (not shown; corresponding to the flange 32 seen in FIGS. 5 and 6) to move transversely within the slot of the base 12 (not shown; corresponding to the slot 28 seen in FIGS. 5 and 6) and cause the entire rail 14 to pivot in a horizontal plane about the upper shaft 39 (FIG. 11) of the adjustment wheel 36.

While the invention has been described in terms of preferred embodiments, it is apparent that other forms could be adopted by one skilled in the art. For example, the mount assemblies could differ in appearance and construction from the embodiments shown in the Figures, and the functions of each component of the mount assemblies could be performed by components of different construction but capable of a similar (though not necessarily equivalent) function. Therefore, the scope of the invention is to be limited only by the following claims.

The invention claimed is:

1. A mount assembly adapted to mount a laser designator to a scope, the mount assembly comprising:

a base comprising means for attaching the mount assembly to a scope:

a rail pivotally attached to the base so as to pivot in first and second planes relative to the base;

a ring assembly on the rail for mounting a laser designator to the rail;

first adjustment means for causing the rail to pivot in the first plane toward and away from the base to effect elevation changes in the trajectory of a laser beam generated by the designator mounted to the mount assembly; and second adjustment means for causing the rail to pivot relative to the base in the second plane to effect windage changes in the trajectory of a laser beam generated by the designator mounted to the mount assembly.

2. The mount assembly according to claim 1, wherein the ring assembly is adjustably mounted to the rail.

3. The mount assembly according to claim 2, wherein the rail and the ring assembly comprise means for linearly moving the ring assembly relative to the rail.

4. The mount assembly according to claim 3, wherein the linear moving means comprises a weaver rail formed in the rail, channels mounted on the ring assembly and slidably engaged with the weaver rail, and means for clamping the channels to the rail.

5. The mount assembly according to claim 4, wherein the linear moving means further comprises slot means defined in a surface of the rail for incrementally positioning the ring assembly along a length of the rail.

6. The mount assembly according to claim 1, wherein the ring assembly and the rail are merged into a unitary piece and the ring assembly is not adjustably movable relative to the rail.

7. The mount assembly according to claim 1, wherein the first and second planes are transverse to each other.

8. The mount assembly according to claim 1, wherein the first adjustment means comprises a first pivot axis, the second adjustment means comprises a second pivot axis that is transverse to the first pivot axis, and the first and second pivot axes are located at opposite ends of the mount assembly.

9. The mount assembly according to claim 1, wherein the first adjustment means comprises a first shaft rotatably received in the base, a second shaft rotatably received in the rail, and means for rotating the first and second shafts, the first and second shafts defining a pivot axis about which the rail pivots relative to the base.

10. The mount assembly according to claim 9, wherein the first shaft is a threaded shaft that is threadably engaged with the base.

11. The mount assembly according to claim 9, wherein the shaft is a threaded shaft that is threadably engaged with the flange.

12. The mount assembly according to claim 1, wherein the second adjustment means comprises a slot in the base, a flange extending from the rail into the slot, a shaft received in the base and passing through the slot and through the flange within the slot and means for rotating the shaft, the shaft defining a pivot axis about which the rail pivots relative to the base.

13. A method of effecting elevation and windage changes in the trajectory of a laser beam generated by a designator mounted to a scope by the mount assembly of claim 1, the method comprising:

using the first adjustment means to cause the rail to pivot in the first plane toward and away from the base and effect an elevation change in the trajectory of the laser beam;

using the second adjustment means to cause the rail to pivot relative to the base in the second plane and effect a windage change in the trajectory of the laser beam; and then setting the elevation and windage changes.

14. A mount assembly adapted to mount a laser designator to a scope, the mount assembly comprising:

a base comprising means for attaching the mount assembly to a scope;

a rail pivotally attached to the base so as to pivot in first and second planes relative to the base;

a ring assembly adjustably mounted to the rail for mounting a laser designator to the rail;

first adjustment means for causing the rail to pivot in the first plane toward and away from the base to effect elevation changes in the trajectory of a laser beam generated by the designator mounted to the mount assembly; and second adjustment means for causing the rail to pivot relative to the base in the second plane to effect windage changes in the trajectory of a laser beam generated by the designator mounted to the mount assembly.

15. The mount assembly according to claim 14, wherein the rail and the ring assembly comprise means for linearly moving the ring assembly relative to the rail.

16. The mount assembly according to claim 15, wherein the linear moving means comprises a weaver rail formed in the rail, channels mounted on the ring assembly and slidably engaged with the weaver rail, and means for clamping the channels to the rail.

17. The mount assembly according to claim 16, wherein the linear moving means further comprises slot means defined in a surface of the rail for incrementally positioning the ring assembly along a length of the rail.

18. The mount assembly according to claim 14, wherein the first adjustment means comprises a first pivot axis, the second adjustment means comprises a second pivot axis that is transverse to the first pivot axis, and the first and second pivot axes are located at opposite ends of the mount assembly.

19. A mount assembly adapted to mount a laser designator to a scope, the mount assembly comprising:

a base comprising means for attaching the mount assembly to a scope;

a unitary piece comprising a rail and a ring assembly on the rail for mounting a laser designator to the rail, the rail being pivotally attached to the base so as to pivot in first and second planes relative to the base, the ring assembly not being adjustably movable relative to the rail;

first adjustment means for causing the rail to pivot in the first plane toward and away from the base to effect elevation changes in the trajectory of a laser beam generated by the designator mounted to the mount assembly; and second adjustment means for causing the rail to pivot relative to the base in the second plane to effect windage changes in the trajectory of a laser beam generated by the designator mounted to the mount assembly.

20. The mount assembly according to claim 19, wherein the first adjustment means comprises a first pivot axis, the second adjustment means comprises a second pivot axis that is transverse to the first pivot axis, and the first and second pivot axes are located at opposite ends of the mount assembly.

* * * * *